United States Patent [19]

Coursen

[11] 4,431,349

[45] Feb. 14, 1984

[54] ICE-FILLED STRUCTURE AND TUNNELLING METHOD FOR THE EGRESS AND LAUNCHING OF DEEP-BASED MISSILES

[75] Inventor: David L. Coursen, Mercersburg, Pa.

[73] Assignee: E. I. Du Pont de Nemours & Co., Wilmington, Del.

[21] Appl. No.: 368,125

[22] Filed: Apr. 14, 1982

[51] Int. Cl.[3] ..... E21D 5/12

[52] U.S. Cl. ..... 405/303; 62/260; 405/132; 405/133; 405/130

[58] Field of Search ..... 405/132, 133, 130, 258, 405/288, 303; 62/260, 259; 299/11, 19

[56] References Cited

U.S. PATENT DOCUMENTS

| | | | |
|---|---|---|---|
| 1,207,569 | 12/1916 | Langerfeld | 405/130 X |
| 3,135,097 | 6/1964 | Scheinberg | 405/130 X |
| 3,344,607 | 10/1967 | Vignovich | 62/260 X |
| 3,365,894 | 1/1968 | Murati | 405/130 |
| 3,581,513 | 6/1971 | Cranmer | 62/260 X |
| 3,790,215 | 2/1974 | Fangel | 405/288 X |
| 3,934,420 | 1/1976 | Janelid et al. | 405/130 X |
| 3,943,722 | 3/1976 | Ross | 405/130 |

*Primary Examiner*—Dennis L. Taylor

[57] ABSTRACT

Missiles located in the deeper (hard rock) portion of a shaft or tunnel are protected from damage during a nuclear attack by a mass of ice, preferably trumpet-shaped, located in the outermost portion (e.g., 600–900 meters.) When missile egress is required, an ice-supported passageway is bored through the ice, preferably by melting. The trumpet shape assures a straight path for missile egress even if the shaft or tunnel should become transversely displaced by a cratering explosion against the surface.

28 Claims, 3 Drawing Figures

ICE-FILLED STRUCTURE AND TUNNELLING METHOD FOR THE EGRESS AND LAUNCHING OF DEEP-BASED MISSILES

BACKGROUND OF THE INVENTION

1. Field of the Invention

The present invention relates to a structure in the earth for protecting one or more deep-based missiles from damage during an attack and for allowing the post-attack egress and launching of the missile, and to a method of forming an egress passageway for the missile through the structure.

2. Description of the Prior Art

Previous proposals have been made that intercontinental ballistic missiles be based so deep in rock that they would be invulnerable to attack by even very large and very accurate thermonuclear warheads. For example, they might be based in underground chambers excavated in dense rock at a depth of 1200–1500 meters below the earth's surface at a location where 600–900 meters of rock nearest the earth's surface is soft, porous, and shock-absorbant. The surface burst of a 60 Megatonne warhead on such a deep-based missile complex might be expected to produce a zone of ruptured and sheared rock having a radius of 900 meters and a depth of 600 meters from the point of explosion. This would collapse any pre-existing exits that would otherwise permit egress and launching of a deep-based missile. Therefore, it has been proposed that rock-boring machinery be provided to those manning such a deep underground missile base, and that after such an attack they would use this machinery to bore their way out to the surface of the earth through the overlying rock. Thereby they would in due time create a passageway through which their missiles could be brought to the surface for launching. The unsuitability of such a basing system for launching a surprise attack, and its invulnerability to surprise attack might be expected to reduce the probability that a surprise attack would be launched at all.

But in order to be a deterrent, such missiles should pose a credible ultimate threat to a would-be attacker. The well-known difficulties of boring through rock and particularly through highly broken rock would be expected to reduce the credibility of such a nuclear deterrent and would substantially increase the cost of such a basing system.

SUMMARY OF THE INVENTION

The present invention provides a structure in the earth which protects one or more deeply buried missiles from damage during a surface attack and is readily adapted to be bored through after an attack to create a passageway permitting egress and launching of the missiles. The structure includes a mass of ice, preferably trumpet-shaped, replacing that portion of rock which otherwise must be bored through after an attack, i.e., the outermost 600–900 meters of such rock, a straight passageway for post-attack egress being formed through the ice, preferably by melting, with the melt water being injected into a disposal well.

The structure of the invention comprises (a) a solid mass of ice filling a conforming portion of a shaft or tunnel in the earth, the wall of the ice-filled portion of the shaft or tunnel and the periphery of the mass of ice adjacent the rock wall preferably flaring outwardly in a trumpet shape to a maximum radius at the earth's surface, the solid mass of ice (1) being coaxial with a deeper portion of the shaft or tunnel adapted to contain at least one missile, and (2) including a straight path between the deeper portion and the earth's surface whereby the ice is adapted to be penetrated so as to provide a passageway for the missile(s), the deeper portion of the shaft or tunnel also being connected with other ancillary underground spaces; and (b) a means of boring outward through the ice along said straight path so as to provide an ice-supported passageway for the missile, this means preferably being a source of heat in an ancillary underground space and means such as steam jets for applying the heat to the ice, whereby a straight, ice-supported passageway is progressively melted through the ice, extending from, and coaxial with, the deeper portion of the shaft or tunnel to the earth's surface for the egress of the missile(s). Also provided are means of disposing of the ice and rubble removed to create this passageway, this means preferably comprising an injection well for receiving melt water and an ancillary space for receiving rubble, and means of disposing of waste heat generated in the underground spaces during such boring operations, this means preferably being the transfer of waste heat to ice, melt water, or well water by means of a heat pump and injection of the resulting warm water down a disposal well. The use of well water requires the presence of a water well in addition to the disposal well.

A cratering explosion against the earth's surface in the vicinity of the structure may cause transverse displacement of the ice-filled portion of the shaft with the largest displacements occurring closest to the earth's surface, but egress of the missile through a straight passageway will still be possible by boring through the displaced ice, owing to the large radius of the ice-filled shaft or tunnel at levels nearer the surface, as will be described more fully hereinafter. Such an explosion will shatter at least a portion of the mass of ice and surrounding rock but the ice will reheal to a competent solid when sheared under the containment provided by the rock.

To prepare the above-described structure for use in forming an egress passageway for a missile, the missile is positioned in the deeper portion of the shaft or tunnel, i.e., the portion located in hard rock, generally down to a level of 1200 to 1500 meters, and apparatus for progressively boring outward through the ice is also placed in the deeper portion of the shaft or tunnel, or in a chamber communicating therewith, also located in the hard rock region. These items may be brought underground through ancillary shafts or tunnels from the surface, not designed to survive an attack, or through the preferably flared shaft or tunnel before it is filled with ice. When needed, the egress passageway is bored through the ice, preferably by melting through the ice, this passageway requiring no support in addition to that provided by the ice itself.

BRIEF DESCRIPTION OF THE DRAWING

In the accompanying drawing, which illustrates specific embodiments of the structure and method of the invention, a shaft rather than a tunnel being chosen for illustrative purposes.

DETAILED DESCRIPTION

A thermonuclear explosion at the earth's surface in the vicinity of the structure of the invention could cause substantial transverse displacement of the surrounding rock and the ice-filled portion of the shaft or tunnel, with the amount of such displacement decreasing with depth and also depending upon the size and location of the explosion, the terrain, and the mechanical properties and water saturation of the rock at each position along its axis. The radius of the ice-filled portion of the shaft or tunnel exceeds the radius of the straight, open passageway required for missile egress by an amount greater than the displacement transverse to the axis of the ice-filled shaft or tunnel likely to be produced in the rock at that position by such an hypothesized thermonuclear explosion. Thereby, the deeper portion of the shaft or tunnel adapted to contain one or more missiles will be connected to the surface of the earth by a straight path through ice even after the displacement of rock and ice resulting from such a surface explosion. The minimum volume of ice needed to meet this requirement will be trumpet-shaped, with the largest radius at the surface.

The depth-dependent transverse displacement of the body of ice and the surrounding rock by the hypothesized explosion will shear and fracture at least a portion of them. But unlike the fractures in the surrounding rock, the fractures in the ice will quickly heal to give a competent solid. Thus, a straight passageway can be bored up or out through the ice to provide an egress path for the missile, and unlike a passageway in sheared rock, the ice wall of this passageway will be competent. Therefore, any severely fractured rock behind the ice wall will be supported by ice and the wall will require little or no additional support.

When the ice is subjected to a shock wave from a nearby cratering explosion, it will be warmed if it is colder than 0° C. and some of it will be melted if it is already at 0° C. The amount of such melting will increase with the initial temperature of the ice and with the strength of the shock wave, and could prevent rehealing of shattered ice if the ice is too warm or if the shock wave is too strong. Consequently, it is preferable that during standby the ice be maintained at a temperature less than 0° C.

Figure 2:
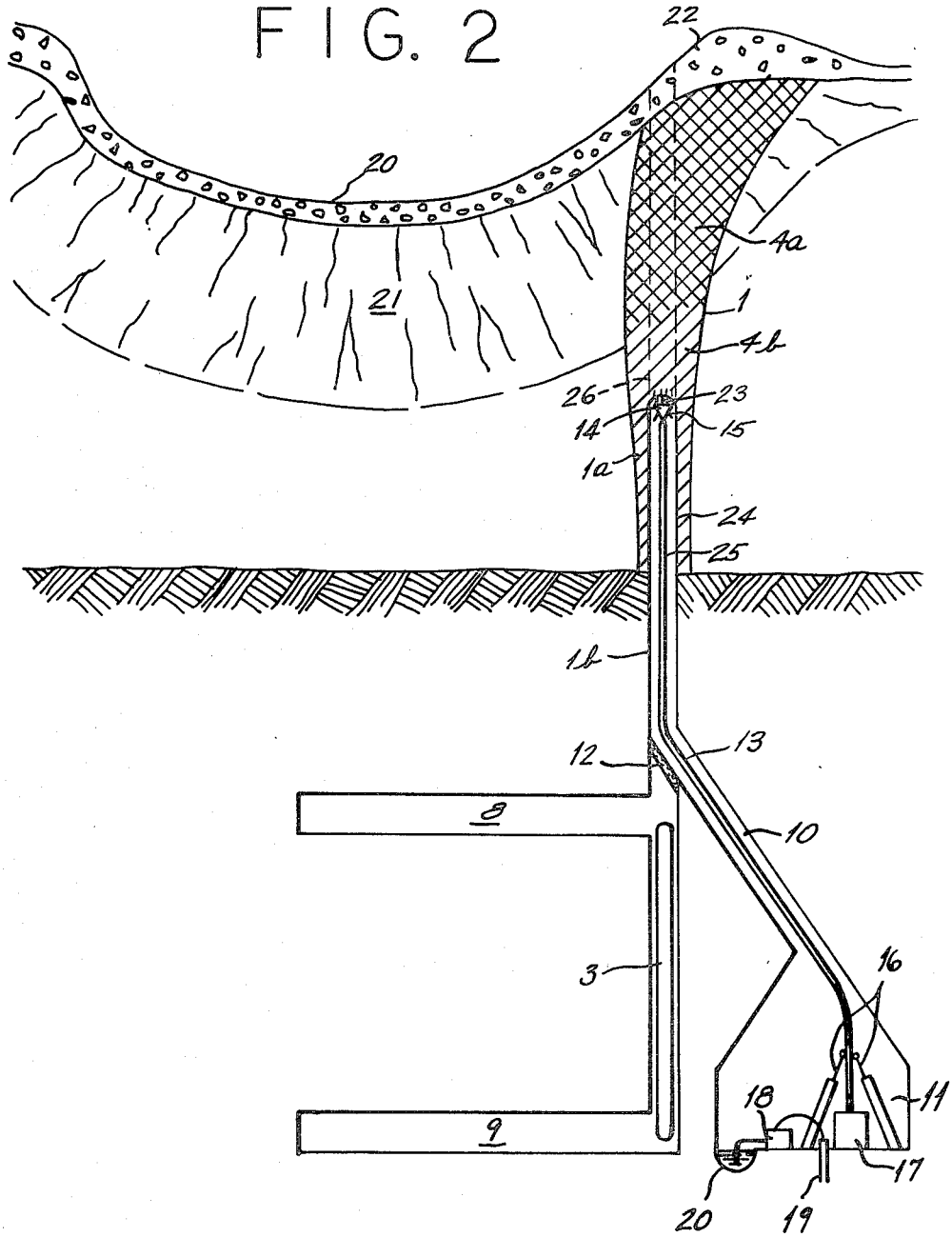
FIG. 2 is a schematic representation of the method of melt-boring through the ice backfill in the structure depicted in FIG. 1 after a cratering explosion at the surface and during the subsequent boring operation.

Rock fragments and earth thrown up by a nuclear explosion at the surface of the earth may fall back on top of the ice mass, thereby burying the position of the desired exit for the passageway under a loose mass of rubble (see FIG. 2). After the passageway has been bored through the ice to the base of this rubble, an opening is formed through the rubble by allowing rubble to cave down the passageway, from which the rubble is diverted into a side chamber so that it does not enter the deeper portion of the shaft or tunnel adapted to contain a missile (see FIG. 3).

The equipment required for reliable boring through ice is relatively simple compared to that required for boring through severely broken rock bacause ice is relatively easy to cut and can also be melted. Melting is preferred because it allows disposal of the material removed (i.e., melt water) by injecting it into a disposal well.

Rejection of waste heat from the various underground operations and underground spaces can be a serious problem after an attack because means of heat transfer to the outside may have been cut off, but is relatively simple in this case. The waste heat can be transferred to the melt water by means of a heat pump before injecting the melt water down the disposal well.

When the exit passageway is bored by melting through the ice, it is most easily accomplished through the use of steam jets, with the steam being produced by an underground heat source. Examples of such heat sources are (1) a nuclear reactor, (2) a mass of high level nuclear waste, (3) combustion of fuel with air, or (4) a geothermal well drilled down from or through the deep-basing complex and tapped in the deep basing complex. Of these, combustion or the geothermal well are preferred. In the latter option, the geothermal well can also be used as the injection well. If combustion is used, a source of air and a means of disposing of combustion products must be provided. These can be provided by steel pipes extending from the underground chambers to the surface, with the 300–900 meters of pipe nearest the surface being in the form of well screen or perforated pipe and separated from the surrounding rock by a zone filled with gravel. Although the top sections of such pipes might be destroyed by a cratering explosion, the underlying section could draw air or discharge exhaust through the zone of rock fractured by the explosion. The gravel-packed sections of pipes used to discharge exhaust should be separated from those used to draw in air by a distance equal to at least several times the anticipated depth of broken rock created by the explosion in order to avoid recirculation of exhaust gases with the air. An alternative method of disposing of the exhaust gases is to pump them down a well.

In the above discussion, the axis of the ice-filled shaft or tunnel and the passage bored through it may be inclined to the vertical by any angle up to and exceeding 90° provided that the terrain permits an exit to be reached in such a direction, but they are preferably vertical.

Figure 1:
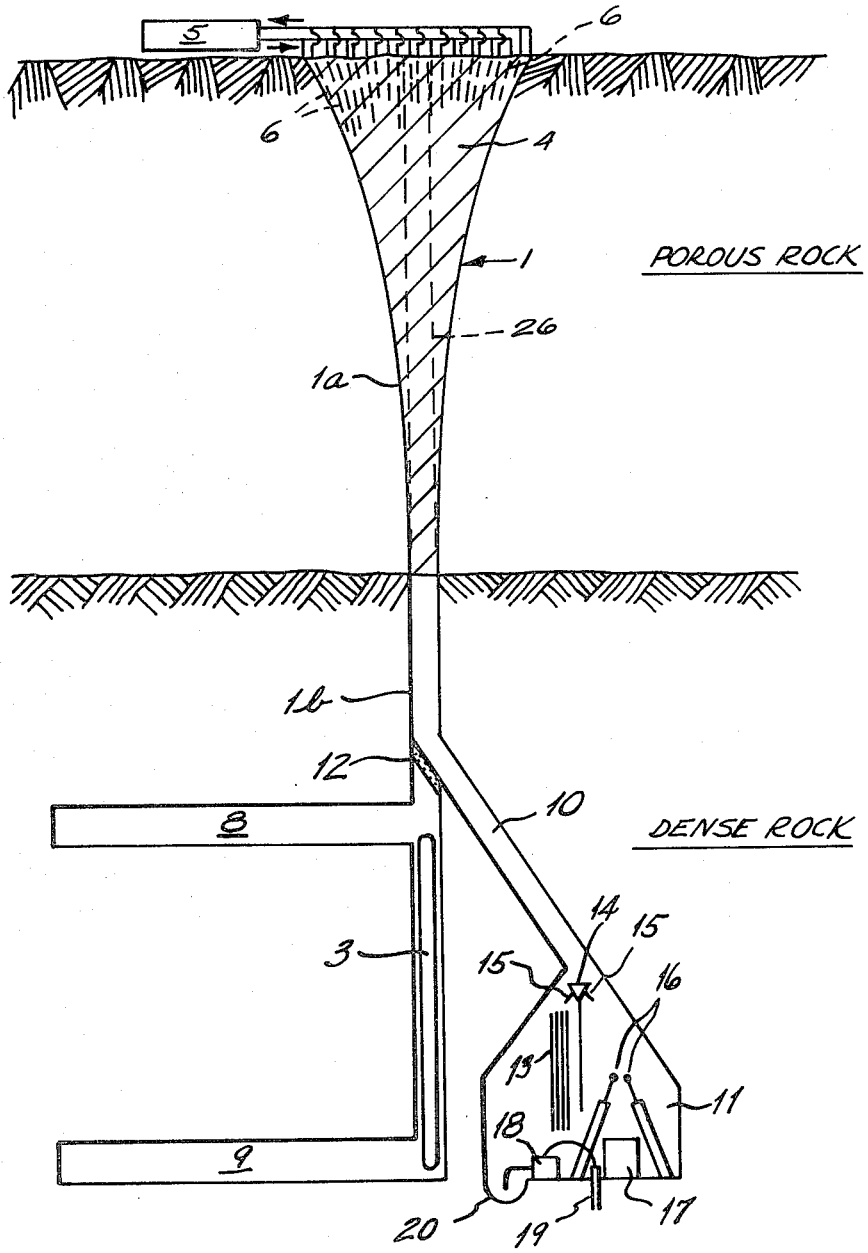
FIG. 1 is a schematic representation of the structure having an ice backfill in a shaft of the preferred trumpet shape sunk into the rock, together with the support equipment used in one embodiment of the method of the invention.

Referring to FIG. 1, a shaft 1 is formed in the earth, leading from the surface 2 to a deep location, in this instance 1200 meters. Shaft 1, which is substantially vertical, preferably has an upper portion 1*a* located in porous shock-absorbant rock and extending from surface 2 to the 600-meter level; and a deeper portion 1*b* located in dense rock and extending from the 600- to the 1200-meter level. A missile 3, preferably enclosed in a protective capsule, is located at the bottom of shaft 1. Portion 1*a* of the shaft is trumpet-shaped and flares outwardly to a maximum radius at surface 2. A typical minimum radius of portion 1*b* is 5–6 meters, and a typical minimum radius of portion 1*a* is 30–60 meters, depending on the strength and water saturation of the surrounding rock and the probable explosive energy of the attacking warheads.

Shaft portion 1*a* is filled with a protective mass of ice 4. It can be seen that a straight path 26 can be drawn from shaft portion 1*b* to surface 2. The ice may be emplaced in any convenient manner, e.g., by water spray if the outside temperature is below freezing, or by means of ice-making machines. Cooling of the surrounding zone of rock may be aided by flowing chilled air or liquid nitrogen down the wall of the shaft. A refrigeration plant 5 located on the surface has tubes 6 containing a chilled, circulating fluid such as brine immersed in ice 4 at the periphery of flared shaft portion 1*a* to keep the ice and the surrounding zone of rock appreciably colder than 0°C. Alternatively, ice on the periphery of the ice mass can be allowed to melt slowly during standby of the facility, with this lost ice being replaced with ice made by the refrigeration plant and added at the top of the ice mass. The rate of such melting would decrease as the surrounding zone of rock gradually became colder.

shaft are ancillary underground spaces represented by horizontal side-shafts 8 and 9. The ancillary spaces include an oblique shaft 10, which joins shaft portion 1*b* to a deep work chamber 11, of sufficient volume to contain ejecta rubble that will be caved into it during the final stage of boring up to the surface. This work chamber may also be used to contain equipment needed only for the earlier stages of boring up through the ice 4 should egress of the missile 3 be desired. Removable deflecting means 12, in place in shaft portion 1*b* above missile 3, prevents water and caved rubble from contacting the missile or its capsule during the operation of boring a straight passageway to the surface of the earth, as will be described later with reference to FIG. 2.

In chamber 11, 13 indicates sections of insulated, flexible steam pipe, which will be assembled together when needed in a melt-boring operation, with steam jet head 14 joined to the leading section of pipe 13. Steam jet head 14 is fitted with guidance arms 15, which keep jet head 14 on an axial course during the melt-boring operation. Also shown located in chamber 11 are jacks 16 for moving the assembled steam pipe up shafts 10 and 1; steam generator 17; and injection pump 18, injection well 19, and sump 20, for collecting melt water from chamber 11. If the injection well 19 is also a geothermal well, it can be used as the steam generator and a separate steam generator 17 is not required; and if the steam generator relies on the energy from a nuclear reactor or radioactive waste, it will preferably be located in a space not to be later filled with caved rubble.

The structure shown in FIG. 1 would be maintained with ice mass 4 in place until after an attack. If the surface should be subjected to a cratering explosion during this attack, the structure will protect the missile from damage accruing therefrom and still permit relatively simple boring outward by melting to allow egress of the missile. Such an explosion would presumably destroy the refrigeration plant but the zone of rock surrounding the ice will be sufficiently cold to prevent melting of ice at the ice-rock interface during the time required to bore the passageway, bring the missile to the surface, and launch it.

FIG. 2 depicts the structure after a cratering explosion at the surface and during a melt-boring operation through ice mass 4. The explosion has left a crater 20 in the surface, with the formation of a layer 21 of sheared, incompetent rock superposed by a layer 22 of crater ejecta rubble. The portion 4*a* of the ice mass that is in the sheared layer 21 is in the sheared, but rehealed, form, and is transversely displaced from the center of the crater. The portion of ice 4*b* beneath the sheared layer 21 remains substantially unsheared.

To carry out the boring operation, steam jet head 14 and the sections 13 of flexible steam pipe are joined together incrementally and jacked up shaft 10 and shaft portion 1*b* by means of jacks 16. When jet head 14 reaches ice mass 4, steam jetting from jets 23 preferably in a toroidal manifold melts the ice ahead of the jet head, which is guided by arms 15. The enlarged radius of the ice mass 4 near the surface ensures that a straight path 26 can be drawn through ice mass 4 despite the fact that portion 4*a* has been horizontally displaced. This allows a substantially straight egress shaft 25 to be bored through the ice of sufficient diameter for the passage of the encapsulated missile to the surface for launching. The melting process removes the portion of the ice mass that lies in the straight path 26, leaving a supporting wall of ice 24 for passageway 25. The melt water flows down to chamber 11, where it is pumped from sump 20 into injection well 19 by pump 18. Deflector 12 keeps the melt water and caving ejecta rubble from entering the portion of shaft 1 which houses missile 3.

Figure 3:
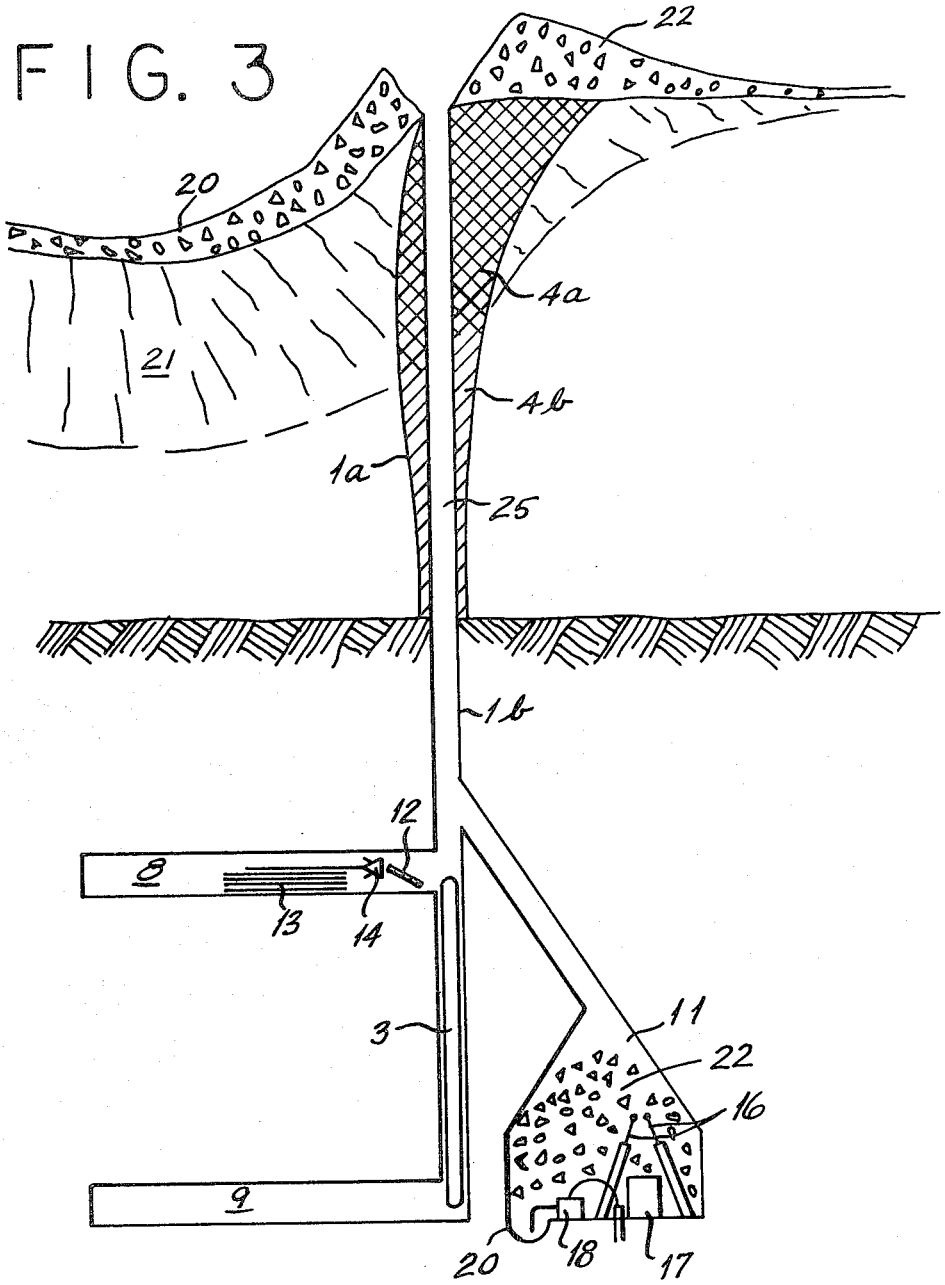
FIG. 3 is a schematic representation of the structure depicted in FIG. 2 after a passageway has been melted up through the ice backfill and the overlying rubble has been caved down this passageway into an ancillary chamber.

FIG. 3 shows the structure of the invention after egress passageway 25 has been completed through the ice mass 4 and the overlying ejecta rubble 22. It can be seen that although the mass of ice has been horizontally displaced from the center of crater 20, the flared configuration of shaft 1 and ice mass 4 allows a straight passageway to be made through the ice to accommodate passage of the missile during its egress. After passageway 25 has been bored through the ice and the crater ejecta rubble 22 adjacent the exit of the passageway has caved down into chamber 11, deflector 12, steam pipe 13 (in sections), and steam jet head 14 are removed from shaft portion 1*b* into side-shaft 8, and the encapsulated missile can be brought to the surface of the earth through the passageway into position for launching.

What is claimed is:

1. A structure comprising (a) a solid mass of ice filling a portion of a shaft or tunnel in the earth, said mass of ice (1) being coaxial with a deeper portion of said shaft or tunnel adapted to contain one or more missiles, and (2 ) including a straight path between said deeper portion and the earth's surface whereby said ice is adapted to be bored so as to provide a passageway for said missile(s); said ice-filled portion of said shaft or tunnel and the periphery of said mass of ice adjacent thereto having a diameter at the earth's surface that is substantially larger than the diameter of the passageway required for passage of said missile(s) and is nowhere smaller than the diameter required for such a passageway; and (b) a means of boring outward through said mass of ice along said straight path so as to form an ice-supported passageway extending to the earth's surface for the egress of said missile(s) from the deeper portion of said shaft or tunnel.

2. A structure of claim 1 wherein said solid mass of ice fills a trumpet-shaped portion of said shaft or tunnel in the earth, the wall of the ice-filled portion of said shaft or tunnel and the periphery of said mass of ice adjacent thereto flaring outwardly to a maximum diameter at the earth's surface.

3. A structure of claim 2 wherein the trumpet-shaped portion of said shaft or tunnel and the periphery of said mass of ice flares outward to a diameter of at least 30 meters at the earth's surface.

4. A structure of claim 1 wherein ice lost by melting along the periphery of said ice mass is replaced by the addition of ice to the top of said ice mass.

5. A structure of claim 1 wherein melting of ice is prevented by the circulation of a chilled fluid through pipes at the periphery of said ice mass.

6. A structure of claim 1 wherein the temperature of said mass of ice is less than 0° C.

7. A structure of claim 1 wherein said means of boring through said mass of ice includes a source of heat in an ancillary underground space and means for applying said heat to the ice, whereby said mass of ice is adapted to be progressively melted, said structure also including means for removing melt water.

8. A structure of claim 1 wherein the axis of said shaft or tunnel is substantially vertical.

9. A structure of claim 1 wherein the ice-filled portion of said shaft or tunnel is located in porous rock, and the deeper portion in dense rock.

10. A structure of claim 9 wherein the ice-filled portion of said shaft or tunnel extends to a distance in the range of about from 600 to 900 meters from the earth's surface.

11. A structure of claim 1 wherein said ice-filled portion of said shaft or tunnel is transversely displaced, and at least a portion of said mass of ice is in the sheared, rehealed form as a result of a cratering explosion at the earth's surface.

12. A structure of claim 1 or 11 wherein a straight passageway extends through said mass of ice from the deeper portion of said shaft or tunnel to the earth's surface, said passageway being coaxial with said deeper portion of said shaft or tunnel, and together with it forming a passageway for the egress of said missile(s) to the surface of the earth.

13. A structure of claim 12 wherein said passageway also passes through sheared rock and rubble in the vicinity of a crater formed in the surface of the earth by a nuclear explosion.

14. A method of producing a structure in the earth for protecting one or more deep-based missiles during attack and allowing their post-attack egress to the surface and launching, which method comprises (a) forming a shaft or tunnel leading from the earth's surface to a location deep within the earth; (b) equipping the deeper portion of said shaft or tunnel, or a chamber communicating therewith, with apparatus for progressively excavating a passageway through a mass of ice; and (c) filling said shaft with a mass of ice in a portion thereof extending from an intermediate distance from the earth's surface to the earth's surface, said mass of ice intervening between the earth's surface and the deeper portion of said shaft containing one or more missiles.

15. A method of claim 14 wherein said shaft or tunnel flares outward to a maximum radius at the earth's surface.

16. A method of forming an egress passageway for one or more missiles in a structure produced by the method of claim 14 comprising penetrating said mass of ice so as to form an ice-supported passageway therethrough extending to the earth's surface.

17. A method of claim 16 wherein any solid ice or rubble produced in forming the passageway is diverted from the underlying shaft or tunnel containing the missile into an ancillary chamber.

18. A method of claim 16 wherein said ice-supported passageway is formed by applying heat to the ice, and removing melt water.

19. A method of claim 18 wherein water is removed from said shaft, tunnel or chamber by pumping it down a well drilled into rock underlying the shaft or tunnel containing the missile(s).

20. A method of claim 18 wherein the passageway is melted through the ice with steam jets.

21. A method of claim 18 wherein the heat for melting the passageway through the ice is obtained from a geothermal well.

22. A method of claim 21 wherein water is injected into the geothermal well.

23. A method of claim 18 wherein the heat for melting the passageway through the ice is obtained from the combustion of fuel with air, the air being drawn from one or more pipes extending from the surface of the earth to the deeper portion of the shaft or underground spaces adjacent to it, with an upper section of the pipes 300 to 900 meters long being well screen or perforated pipe and separated from the surrounding rock by a zone filled with gravel.

24. A method of claim 23 wherein the combustion products are rejected through perforated pipes like those used for drawing in air.

25. A method of claim 23 wherein the combustion products are injected into a well.

26. A method of claim 18 wherein the heat for melting the passageway through the ice is obtained from a nuclear reactor.

27. A method of claim 18 wherein the heat for melting the passageway through the ice is obtained from high-level nuclear waste.

28. A method of claim 16 or 18 wherein heat generated in the underground spaces is transferred to ice, melt water, or well water and the resulting warmed water is pumped down a disposal well.

* * * * *